US011602868B2

(12) United States Patent
Tomassetti

(10) Patent No.: US 11,602,868 B2
(45) Date of Patent: Mar. 14, 2023

(54) WARMING LUBRICATION STRIPS OR LUBRICATING MATERIAL ON RAZOR BLADE CARTRIDGE

(71) Applicant: Louis D. Tomassetti, Pompano Beach, FL (US)

(72) Inventor: Louis D. Tomassetti, Pompano Beach, FL (US)

(73) Assignee: HEATED BLADES HOLDING COMPANY, LLC, Pompano Beach, FL (US)

( * ) Notice: Subject to any disclaimer, the term of this patent is extended or adjusted under 35 U.S.C. 154(b) by 0 days.

(21) Appl. No.: 16/845,369

(22) Filed: Apr. 10, 2020

(65) Prior Publication Data

US 2020/0324426 A1 Oct. 15, 2020

Related U.S. Application Data

(60) Provisional application No. 62/832,069, filed on Apr. 10, 2019.

(51) Int. Cl.

| | |
|---|---|
| ***B26B 21/48*** | (2006.01) |
| ***B26B 21/40*** | (2006.01) |
| ***B26B 21/44*** | (2006.01) |
| *B26B 21/52* | (2006.01) |

(52) U.S. Cl.

CPC ..... *B26B 21/48* (2013.01); *B26B 21/405* (2013.01); *B26B 21/4081* (2013.01); *B26B 21/443* (2013.01); *B26B 21/526* (2013.01)

(58) Field of Classification Search

CPC ... B26B 21/48; B26B 21/405; B26B 21/4081; B26B 21/443

See application file for complete search history.

(56) References Cited

U.S. PATENT DOCUMENTS

| | | | | |
|---|---|---|---|---|
| 6,836,966 | B2 * | 1/2005 | Patrick | B26B 19/382 30/140 |
| 8,479,624 | B2 * | 7/2013 | Flyash | A61B 18/082 83/13 |
| 8,533,958 | B2 * | 9/2013 | Tomassetti | A45D 27/29 30/34.05 |
| 8,661,687 | B2 * | 3/2014 | Rebaudieres | B26B 21/405 30/34.05 |
| 8,713,801 | B2 * | 5/2014 | Bohmer | B26B 21/48 30/34.05 |
| 9,440,366 | B2 * | 9/2016 | Tomassetti | B26B 21/405 |
| 10,099,393 | B2 * | 10/2018 | Gester | B26B 21/48 |

(Continued)

*Primary Examiner* — Omar Flores Sanchez

(74) *Attorney, Agent, or Firm* — Malloy & Malloy, P.L.; Robert M. Downey

(57) ABSTRACT

A razor having a handle and blade cartridge containing one or more blades includes a battery power source and a heating system powered by the battery source for heating the one or more blades and/or a heating element on the blade cartridge. The blade cartridge further includes a strip of lubricating material thereon that is heated by the heating system when the blades and/or heating element warm up. As the strip of lubricating material is warmed up, it provides a release of extra lubricating chemicals, including fats or other lubricating agents. This helps to provide a more comfortable shave while also protecting the user's skin both during shaving and after shaving.

2 Claims, 1 Drawing Sheet

(56) References Cited

U.S. PATENT DOCUMENTS

2008/0086888 A1* 4/2008 Scheinfeld ..... B26B 21/443
30/41
2009/0000123 A1* 1/2009 Trezon ..... B26B 21/40
30/34.1

* cited by examiner

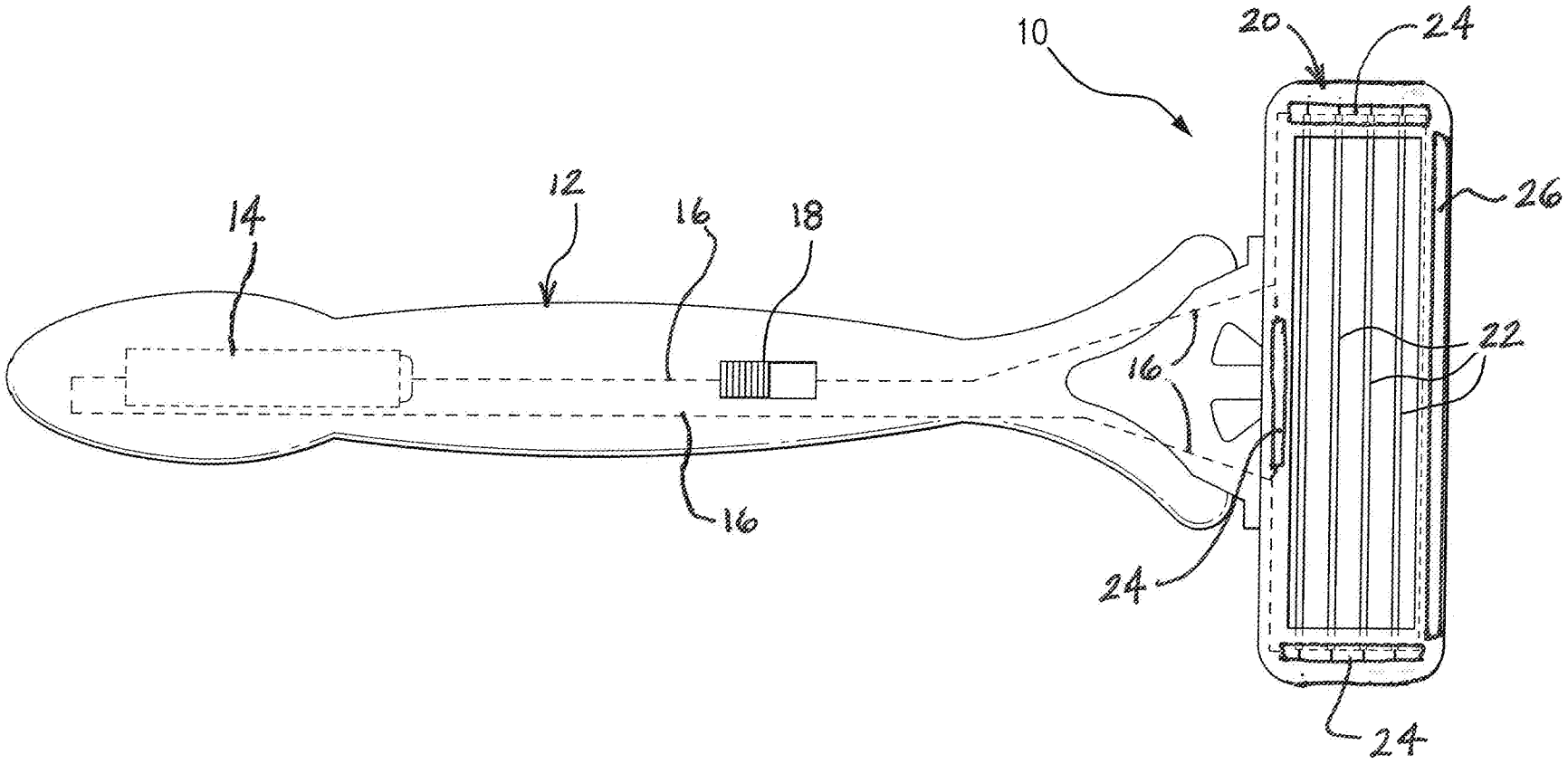
10
20
24
26
22
24
24
16
18
16
16
12
14

WARMING LUBRICATION STRIPS OR LUBRICATING MATERIAL ON RAZOR BLADE CARTRIDGE

BACKGROUND OF THE INVENTION

This non-provisional patent application is based on provisional patent application Ser. No. 62/832,069 filed on Apr. 10, 2019.

FIELD OF THE INVENTION

The present invention relates to razors for shaving and, more particularly, to a wet shave razor having a battery powered system in the razor for heating one or more blades and/or a heating element on the blade cartridge while also warming a strip of lubricating material on the cartridge.

DISCUSSION OF THE RELATED ART

It is well-known that hairs are softened and easier to cut when they are heated just prior to being cut by the sharp cutting edge of a razor blade. It is also known that the cutting edge of the razor blade is more effective in cutting hairs when the blade is warm or hot. Just prior to shaving, most people warm the hairs and skin with hot water or a hot towel. It is also common practice to place the wet shave razor under hot running water in order to heat the blades just prior to stroking the blades over the skin in order to cut the hairs. However, the heat cutting performance of the blades lasts only a short time during the beginning of the shaving stroke. Within seconds, the temperature of the skin, hairs and blade are quickly reduced due to exposure to the ambient air temperature. Ideally, it is best to maintain the blades warm or hot during the shaving process. To solve this problem, the inventor herein has previously developed a heated blade razor, wherein the blades of the razor are heated and maintained at a warm temperature throughout the shaving process. This serves to allow for a more comfortable shave, while improving the cutting performance of the blades. It has also been contemplated to heat a heating element on the blade cartridge to provide comfort during the shaving process.

In addition to heating the blade cartridge, others have proposed use of lubricating material on the blade cartridge to promote a smoother shave. More particularly, the lubricating strip on the cartridge helps the cartridge to move across the skin surface in a smoother action, as the lubricating strip engages the skin. However, it has been found that existing lubricating strips on razor cartridges do not effectively release a sufficient amount of lubricating material onto the user's skin that can help to not only provide a more comfortable shave, but to protect the user's skin both during and after shaving.

The present invention provides a razor that not only heats the blades and/or a heating element on the blade cartridge, but which also warms a lubricating strip or other lubricating material on the blade cartridge in order to promote extra release of lubricating agents, including fats and other lubricating materials onto the user's skin as the blade cartridge is moved across the user's skin, thereby providing a more comfortable shave while also applying a lubricating material to the user's skin that helps protect the user's skin both during shaving and after shaving.

SUMMARY OF THE INVENTION

The present invention is directed to a wet shave razor that applies a warmed lubricating material to the user's skin during shaving. The razor includes a handle and a blade cartridge containing one or more blades. The razor further includes a battery power source and a heating system powered by the battery source for heating the one or more blades and/or a heating element on the blade cartridge. The blade cartridge further includes a strip of lubricating material thereon that is heated by the heating system when the blades and/or heating element warm up. As the strip of lubricating material is warmed up, it provides a release of extra lubricating chemicals, including fats or other lubricating agents. This helps to provide a more comfortable shave, while also protecting the user's skin both during shaving and after shaving.

BRIEF DESCRIPTION OF THE DRAWINGS

For a fuller understanding of the nature of the present invention, reference should be made to the following detailed description taken in conjunction with the accompanying drawings in which:

FIG. 1 is a front plan view of the razor of the present invention, in accordance with one embodiment thereof, showing the handle with a battery power source therein, a heating system for heating the blades and/or a heating element on the blade cartridge and a strip of lubricating material on the blade cartridge which is warmed as a result of the blades or heating element being heated.

Like reference numerals refer to like parts throughout the several views of the drawings.

DETAILED DESCRIPTION OF THE PREFERRED EMBODIMENT

Referring to FIG. 1, one embodiment of the razor of the present invention is shown and is generally indicated as 10. The razor 10 includes a handle 12 and a blade cartridge 20 that is pivotally attached to the handle 12. The blade cartridge 20 includes at least one, and preferably three or more blades 22. The handle 12 includes a battery power source 14, which may be a replaceable battery or a rechargeable battery. The battery power source 14 delivers electric current through conductors 16 to the blade cartridge 20 in order to direct electric current flow through the blades 22 and/or one or several heating elements 24 on the blade cartridge 20 by operation of a switch 18. The blade cartridge 20 further includes a lubricating material 26 thereon which is preferably along the top portion of the blade cartridge 20, that engages the user's skin during the shaving process. The lubricating material 26 may be in the form of a lubricating strip. When the one or more blades 22 and/or heating elements 24 on the blade cartridge 20 are heated, the lubricating material 26 on the blade cartridge is warmed. This is a result of the heat from the blades 22 and/or heating elements 24.

A benefit of heating the blades 22 and/or the heating element(s) 24 on or near the blade cartridge of a wet shave razor is the warming of the lubricating material 26 on the cartridge. One reason the lubricating material 26 warms up is because it acts as a water net. That is, the lubricating material 26 has moisture which conducts electricity. In response, the lubricating material warms, thus providing release of extra lubricating chemicals or other agents in the lubricating material onto the user's skin. In one embodiment, the strip of lubricating material 26 is made of a material that is entirely solid, but when it is warmed up, it releases the lubrication agents. This is similar to a bar of soap. In particular, as it is warmed up, the lubricating material 26 becomes softer and more pliable, and at the same time releases more fats or other lubricating agents. Warming the lubricating material 26 on the blade cartridge 20 not only provides for a more comfortable shave, it helps to treat and protect the user's skin both during shaving and after shaving.

While the present invention has been shown in accordance with a preferred and practical embodiment, it is recognized that departures from the instant disclosure are fully contemplated within the spirit and scope of the present invention which is not to be limited except as defined in the following claims as interpreted under the Doctrine of Equivalents.

What is claimed is:

1. A method of applying lubrication to the skin while shaving, the method comprising the steps of:

providing a razor having a handle and a blade cartridge containing at least one blade, and the razor further including a battery power source and a heating system powered by the battery source for directing electric current flow through the at least one blade, and the razor further including a strip of solid lubricating material on the exterior of the blade cartridge for direct engagement with a user's skin when shaving with the razor;

heating the at least one blade as a result of the electric current flowing through the at least one blade;

warming the strip of solid lubricating material and causing the strip of solid lubricating material to soften to promote release of lubricating agents in the strip of solid lubricating material onto the user's skin;

moving the blade cartridge along the user's skin so that the warmed strip of solid lubricating material is in contact with the user's skin; and causing the lubricating agents in the warmed and softened strip of solid lubricating material to be released onto the user's skin as the blade cartridge is moved along the user's skin.

2. A method of applying lubrication to the skin while shaving, the method comprising the steps of:

providing a razor having a handle and a blade cartridge containing at least one blade and at least one heating element, and the razor further including a battery power source and a heating system powered by the battery source for directing electric current flow to the at least one heating element, and the razor further including a strip of lubricating material on the exterior of the blade cartridge for direct engagement with a user's skin when shaving with the razor;

heating the at least one heating element by the electric current flow;

warming the strip of lubricating material;

moving the blade cartridge along the user's skin so that the warmed strip of lubricating material is in contact with the user's skin; and causing the warmed lubricating material to be released onto the user's skin as the blade cartridge is moved along the user's skin.

* * * * *